US009647337B1

(12) United States Patent
Kuo

(10) Patent No.: US 9,647,337 B1
(45) Date of Patent: May 9, 2017

(54) DUAL-BAND ANTENNA WITH GROUNDED PATCH AND COUPLED FEED

(71) Applicant: Amazon Technologies, Inc., Seattle, WA (US)

(72) Inventor: Jerry Weiming Kuo, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 194 days.

(21) Appl. No.: 14/577,585

(22) Filed: Dec. 19, 2014

(51) Int. Cl.
*H01Q 1/24* (2006.01)
*H01Q 5/328* (2015.01)
*H01Q 5/364* (2015.01)
*H01Q 5/335* (2015.01)

(52) U.S. Cl.
CPC ..... *H01Q 5/328* (2015.01); *H01Q 5/335* (2015.01); *H01Q 5/364* (2015.01)

(58) Field of Classification Search
CPC ..... H01Q 1/243; H01Q 9/0421; H01Q 9/42; H01Q 5/371; H01Q 5/357; H01Q 5/378; H01Q 1/36; H01Q 5/50; H01Q 9/26; H01Q 19/005
USPC ..... 343/702, 700 MS, 846, 848, 876
See application file for complete search history.

(56) References Cited

U.S. PATENT DOCUMENTS 7,161,543 B2 * 1/2007 Cheng ..... G06F 1/1616 343/700 MS
8,754,817 B1 * 6/2014 Kuo ..... H01Q 1/243 343/700 MS
2003/0112195 A1 * 6/2003 Cheng ..... H01Q 9/42 343/767
2004/0075611 A1 * 4/2004 Kenoun ..... H01Q 1/243 343/702
2005/0243006 A1 * 11/2005 Lin ..... H01Q 9/0421 343/770
2006/0132360 A1 * 6/2006 Caimi ..... H01Q 1/243 343/700 MS
2007/0164904 A1 * 7/2007 Nahar ..... H01Q 1/22 343/700 MS
2007/0222697 A1 * 9/2007 Caimi ..... H01Q 1/243 343/861
2008/0111745 A1 * 5/2008 Takada ..... H01Q 1/243 343/700 MS
2010/0053007 A1 * 3/2010 Ni ..... H01Q 9/0421 343/745
2014/0111382 A1 * 4/2014 Lee ..... H01Q 5/357 343/700 MS
2014/0292587 A1 * 10/2014 Yarga ..... H01Q 1/243 343/702
2015/0214626 A1 * 7/2015 Liu ..... H01Q 9/145 343/852

* cited by examiner

*Primary Examiner* — Linh Nguyen
(74) *Attorney, Agent, or Firm* — Lowenstein Sandler LLP

(57) ABSTRACT

Methods and systems for radiating electromagnetic energy with a patch antenna structure are described. A device may include a radio frequency (RF) feed and an antenna structure coupled to the RF feed. The antenna structure may include a ground plane, first and second conductors, and first and second impedance matching components. The first conductor may include an inner surface defining and at least partially surrounding a slot. The first and second impedance matching components may be coupled between the RF feed and the ground plane.

20 Claims, 10 Drawing Sheets

DUAL-BAND ANTENNA WITH GROUNDED PATCH AND COUPLED FEED

BACKGROUND OF THE INVENTION

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops, and the like. These electronic devices wirelessly communicate with a communications infrastructure to enable the consumption of the digital media items. In order to wirelessly communicate with other devices, these electronic devices include one or more antennas. Various types of antennas can be used in user devices.

A planar antenna is a type of radio antenna with a low profile, which can be mounted on a flat surface. A planar antenna includes a flat rectangular sheet or "patch" of metal, mounted over a larger sheet of metal called a ground plane. Planar antennas are simple to fabricate and may take a wide variety of forms. Typical planar antennas have two metal sheets that together form a resonant piece of transmission line with a length. The radiation mechanism arises from discontinuities at each truncated edge of the planar antenna.

BRIEF DESCRIPTION OF THE DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION OF THE PRESENT INVENTION

Methods and systems for radiating and receiving electromagnetic energy with a patch antenna structure are described. The patch antenna structure may be formed of a metal member of a user device and is coupled to a ground plane and a radio frequency (RF) feed. The patch antenna structure is configured to radiate at an opening between the patch antenna and the ground plane. In one embodiment, the patch antenna can be configured to operate as a dual-band antenna for wireless local area network (WLAN) applications, such as Wi-Fi® networks at 2.4 gigahertz (GHz) and 5 GHz frequency bands.

The user device may be any content rendering device that includes a wireless modem for connecting the user device to a network. Examples of such user devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

Figure 1A:
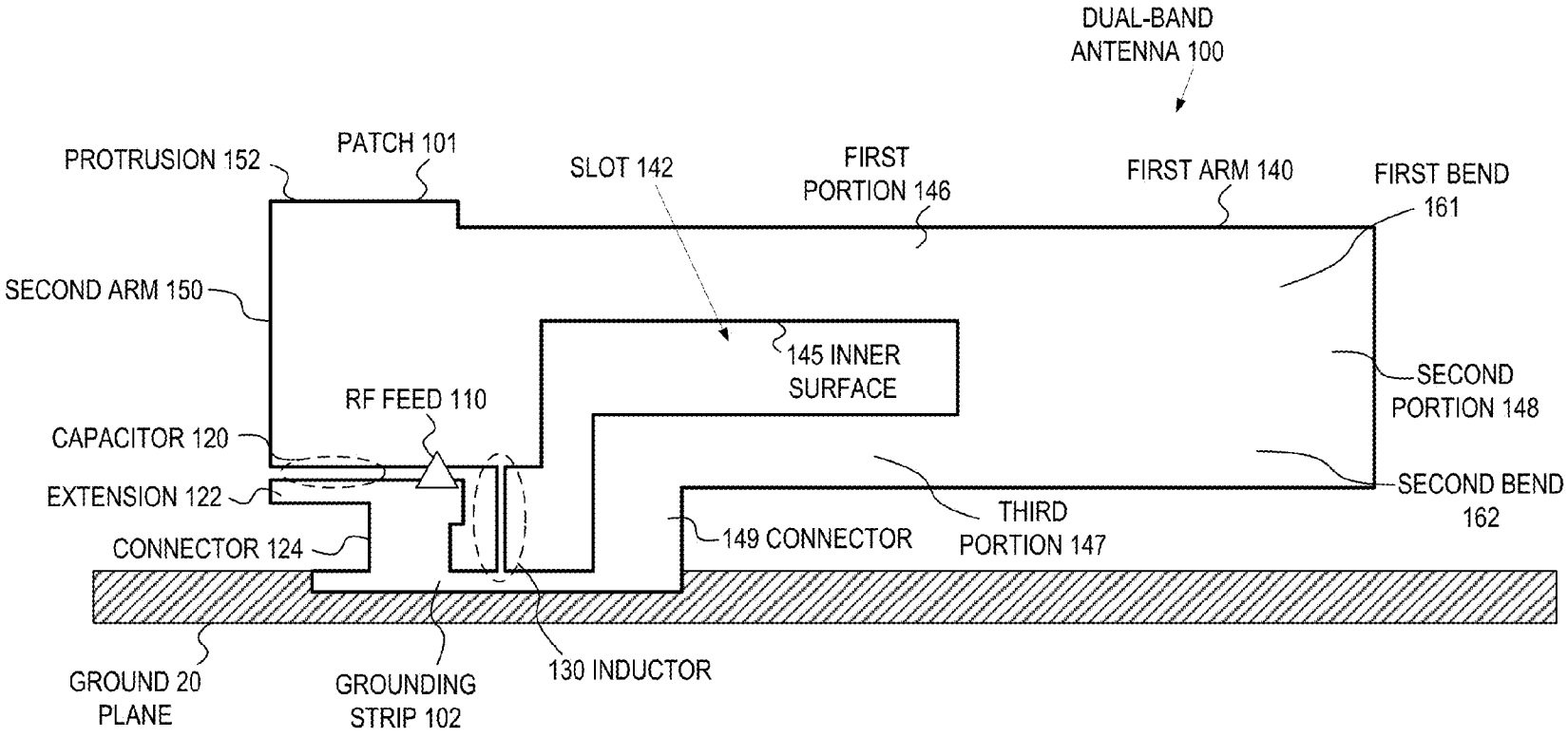
FIG. 1A illustrates an embodiment of a dual-band antenna.

FIG. 1A illustrates an embodiment of a dual-band antenna 100. The dual-band antenna includes a patch 101 of metal mounted over a ground plane 20. The patch 101 may be approximately 0.1 to 0.5 millimeters (mm) thick. The ground plane 20 may be a metal frame of an electronic device. The ground plane 20 may be a system ground or one of multiple grounds of the electronic device. The patch 101 includes a grounding strip 102 that physically couples the patch 101 to the ground plane 20.

The dual-band antenna 100 may be disposed in an electronic device that includes circuitry that drives a single radiation frequency (RF) feed 110. The RF feed 110 may be a feed line connector that couples the dual-band antenna 100 to a respective transmission line of the electronic device. The RF feed 110 is a physical connection that carries the RF signals to and/or from the dual-band antenna 100. The feed line connector may be any one of the three common types of feed lines, including coaxial feed lines, twin-lead lines or waveguides. A waveguide, in particular, is a hollow metallic conductor with a circular or square cross-section, in which the RF signal travels along the inside of the hollow metallic conductor. Alternatively, other types of connectors can be used. The feed line connector may be directly connected to the dual-band antenna 100 or connected to the dual-band antenna 100 with an impedance matching network. In the embodiment of FIG. 1, the RF feed 101 is coupled to the dual-band antenna 100 at a first end of the dual-band antenna 100 between a capacitor 120 and an inductor 130. In other embodiments, the RF feed 110 may be coupled to the dual-band antenna 100 such that the capacitor 120 and inductor 130 are on the same side of the RF feed 101. The RF feed 110 may be coupled to the dual-band antenna 100 in other locations.

When a current is induced at the RF feed 101, the dual-band antenna 100 radiates electromagnetic energy to communicate information to another device. The current may have a particular frequency and the electromagnetic energy may radiate at that same frequency. The strength of the radiated electromagnetic energy (for a particular current strength) is frequency-dependent, defining a frequency-dependent radiation efficiency.

The dual-band antenna 100 may have a high radiation efficiency in a first band of first band of frequencies (e.g. a low band centered around approximately 2.4 gigahertz (GHz)) and at a second band of frequencies (e.g., a high band centered around approximately 5.0 GHz). The low band may extend between approximately 2.3 GHz and 2.5

GHz. The high band may be a wide band range of frequencies from approximately 4.3 GHz to 10.0 GHz and may include a lower portion from approximately 4.3 GHz to 7.0 GHz and a higher portion from approximately 7.0 GHz to 10.0 GHz.

In the low band, the dual-band antenna 100 operates as a monopole antenna. A monopole antenna generally consists of a quarter-wavelength long conductor usually perpendicular to a large conductor, such as the ground plane 20. The dual-band antenna 100 includes a first arm 140 which operates as such a quarter-wavelength long conductor for the low band.

The first arm 140 is coupled to the RF feed and extends in a first direction. Because the first direction is not perpendicular to the ground plane 20 (e.g., the first arm 140 does not extend out of the page in FIG. 1), the dual-band antenna 100 operates, at least in the low band, as a folded-monopole antenna, with a capacitance between the arm 140 and the ground plane 20. The dual-band antenna 100 further includes an inductor 130 located proximal to the RF feed 110. The inductor 130 may operate to short the folded-monopole antenna to become a shorted-folded-monopole antenna, improving both matching and bandwidth. In one embodiment, the inductor 130 has an inductance of approximately 4 to 6 nanohenries (nH). All other inductance values may be used. The inductor 130 may be a part of the patch 101, such as a shorting pin, or one or more discrete elements. The inductor 130 has a first end coupled to the RF feed 110 and a second end coupled to the grounding strip 102. The inductor 130 may be a narrow strip of the patch approximately 0.1 mm wide and 2.2 mm long. Because the strip is narrow, the strip acts as an inductor, introducing a higher impedance for higher frequencies (e.g., greater than 1 GHz) than is introduced for lower frequencies. The inductor 103 may be capacitive if, instead of extending all the way to the grounding strip 102, extends only partially towards the grounding strip 102, leaving a gap between the grounding strip 102 and the second end of the inductor 103.

Because the arm 140 is located near the ground plane 20, the dual-band antenna 100 may operate in the low band as an inverted-F antenna (IFA). Further, because the patch 101 may be parallel to the ground plane 20, spaced apart from the ground plane in a direction out of the page in FIG. 1A, the dual-band antenna 100 may operate in the low band as monopole antenna or a planar inverted-F antenna (PIFA) using the first arm 140 as a conductor.

At the high band, the dual-band antenna 100 may also operate as a PIFA with a second arm 150 as the quarter-wavelength conductor. The second arm 150 is coupled to the RF feed 110 and may extend from the RF feed 110 in a second direction that is opposite the first direction that the first arm 140 extends from the RF feed 110. For example, in FIG. 1, the first arm 140 extends to the right of the RF feed 110 and the second arm 150 extends to the left of the RF feed 110.

To assist in matching at the high band, the dual-band antenna 100 includes a capacitor 120 located proximal to the RF feed 110. The capacitor 120 may operate to artificially extend the length of the second arm 150 to better match the frequencies of the high band. The capacitor 120 may have a capacitance of approximately 0.5 to 2 picofarads (pF). All other capacitance values may be used. The capacitor 120 may be part of the patch 101 or one or more discrete elements. In particular, the capacitor 120 may be part of the patch 101, formed by a first surface of the second arm 150 and a second surface of an extension 122 that is coupled to the grounding strip 102 via a connector 124. The size of the connector 122 may be chosen to provide a low-impedance connection to the ground plane 20. Because of the presence of the capacitor 120, the dual-band antenna 100 may operate in the high band as a capacitive-loaded PIFA.

A height of the second arm 150 may differ from a height of the first arm by means of a protrusion 152. The dimensions of the protrusion 152 may be chosen to assist in tuning the resonant mode in low band to a particular frequency. In particular, the second arm 150 may comprises a protrusion such that the first arm 140 extends a first distance from the grounding strip 102, the second arm 150 extends a second distance from the grounding strip 102, and the second distance is greater than the first distance.

The dual-band antenna 100 further includes a slot 142 in the first arm 140. The slot 142 contributes a higher harmonic of the PIFA, resulting in matching at the higher portion of the high band. In particular, the first arm 140 includes a first portion 146, a second portion 148, and a third portion 147 defining an inner surface 145 surrounding the slot 142. An electrical path may be defined from the RF feed 110 through the first portion 146, through the second portion 148, through the third portion 147, and through a connector 149 to ground plane 20 (and, thus, back to the RF feed 110). The size of the connector 149 may be chosen to provide a low-impedance connection to the ground plane 20.

Each of the first portion 146, second portion 148, and third portion 147 may be rectangular (as illustrated) or otherwise shaped. Each of the first portion 146, second portion 148, and third portion 147 may include a first end that is opposite a second end. The first portion 146 has a first end that is connected to the RF feed 110 and a second end that is connected to a first end of the distal portion 148. The second portion 148 has a first end that is connected to the second end of the first portion 146 and a second end that is connected to a first end of the third portion 147. The third portion 147 has a first end that is connected to the second end to the second portion 148 and a second end that is connected to the connector 149, which couples the third portion 147 to the grounding strip 102. It is noted that the third portion 147 does not connect to the RF feed 110, except through the grounding strip 102 and the other portions 146, 148.

The first portion 146 extends in a first direction from the RF feed 101 to a first bend 161. The second portion 148 extends in a second direction perpendicular to the first direction from the first bend 161 to a second bend 162. The third portion 147 extends in a third direction opposite the first direction from the second bend 162 to the connector 149. As shown in FIG. 1A, the first arm 140 extends from the RF feed 101 in the first direction and the second arm 150 extends from the RF feed 101 in the third direction opposite the first direction.

Thus, the dual-band antenna 100 operates in the low band as a PIFA using the first arm 140 as a conductor and in the high band as a capacitive-loaded PIFA using the second arm 150 as a conductor with the slot 142 contributing the higher portion of the high band via a higher harmonic. Thus, the dual-band antenna 100 provides a resonant mode in a low band and multiple resonant modes in the high band, resulting in a wide range of coverage at the high band. In particular, in the high band, the dual-band antenna 100 may use the second arm 150 as a conductor to radiate at a lower portion of the high band and the slot 142 of the first arm 140 to radiate at a higher portion of the high band via a higher harmonic. In combination, the second arm 150 and the slot 142 result in a wide range of coverage at the high band (e.g., from 4.3 GHz to 10.0 GHz). The size of the slot 142 (and the portions defining it) may be chosen to match particular a particular frequency range in the higher portion of the high band. Further, the first arm 140 may be used, not just for the higher harmonic provided by the slot 142, but also as a conductor for radiating at the low band.

As noted above, the patch 101 may be a planar piece of metal. The patch 101 may be as a single homogenous piece of material. The patch 101 may be formed by stamping a sheet of metal or by any other method. The patch 101 includes a first arm 140 extending from a reference point (e.g., where the RF feed is connected 110) in a first direction (to the right in FIG. 1A). The first arm 140 includes a first portion 146 extending in the first direction from the reference point to a first bend 161, a second portion 148 extending in a second direction (down in FIG. 1A) perpendicular to the first direction from the first bend 161 to a second bend 162, and a third portion 147 extending in a third direction (to the left in FIG. 1A) from the second bend 162. The patch 101 further includes a second arm 150 extending from the reference point in the third direction (to the left in FIG. 1A).

The patch 101 includes a strip 102 extending in the first direction and spaced apart from the first arm 140 and the second arm 150 in the second direction. The patch 101 includes a shorting pin 130 extending in the second direction from the first arm 140 to the strip 102 and an extension 122 extending in the third direction and spaced apart from the second arm 150 in the second direction.

As described above, the shorting pin 130 may introduce an inductance between the first arm 140 and the strip 102. The inductance may be approximately 4 to 6 nanohenries. The extension 122 may introduce a capacitance between the second arm 150 and the strip 102. The capacitance may be approximately 0.5 to 2.0 picofarads.

The patch 101 may further include a first connector 149 that extends in the second direction from the third portion 147 to the strip 102 and a second connector 124 that extends from the extension 122 to the strip 102.

The patch 101 may be used as part of a dual-band antenna 100 in which the patch 101 is coupled to a ground plane 20 via the strip 102 and coupled to an RF feed 110 at the reference point.

Figure 1B:
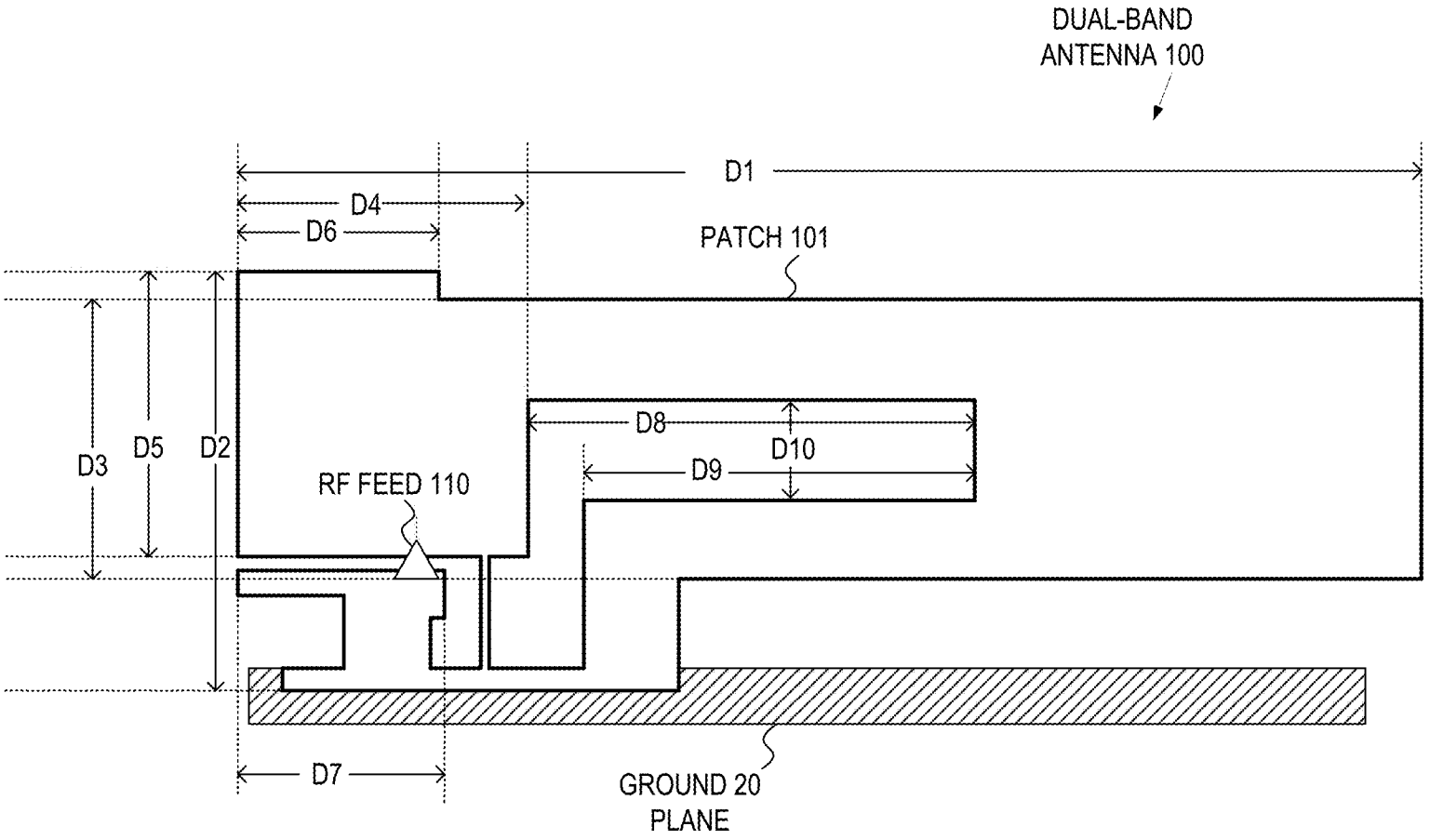
FIG. 1B illustrates dimensions of the components of the dual-band antenna of FIG. 1A.

FIG. 1B illustrates dimensions of the components of the dual-band antenna 100 of FIG. 1A. The patch 101 of the dual-band antenna may have a total width (D1) of approximately 24.0 mm and a total height (D2) of approximately 8.5 mm. A portion including the first arm 140 may have a height (D3) of approximately 5.5 mm. A portion including the second arm 150 may have width (D4) of approximately 6.0 mm and a height (D5) of approximately 5.7 mm. The second arm 150 may include a protrusion 152 having a width (D6) of approximately 4.0 mm. A portion including the extension 122 may have a width (D7) of approximately 4.2 mm. The slot 142 in the first arm 140 may be defined by an inner surface 145 having a first width (D8) on a first side of approximately 9.0 mm, a second width (D9) on a second side of approximately 8.0 mm, and a height (D10) of approximately 2.0 mm.

Figure 2:
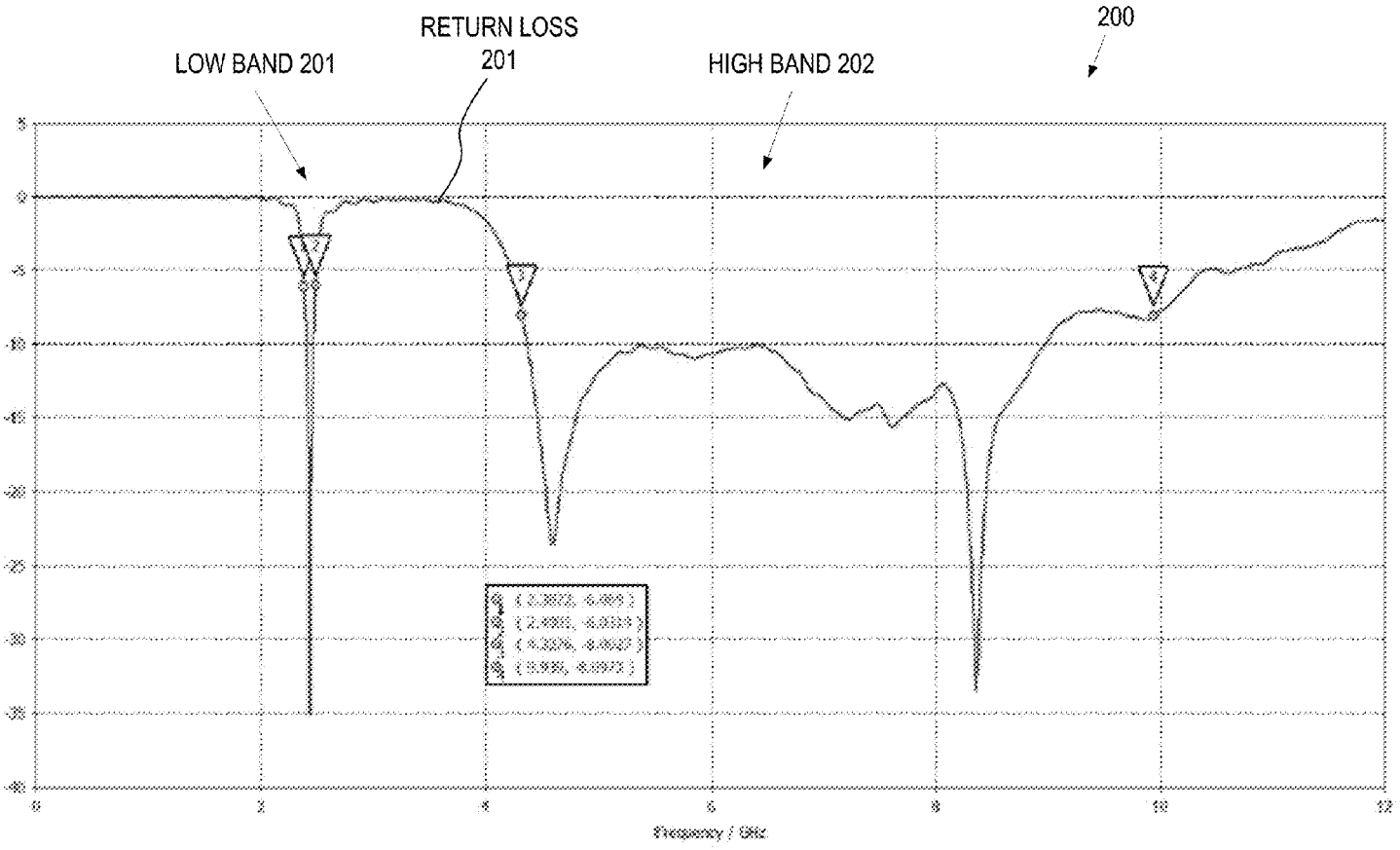
FIG. 2 is a graph of return loss of the dual-band antenna of FIG. 1A according to one embodiment.

FIG. 2 is a graph 200 of return loss 201 of the dual-band antenna 100 of FIG. 1A according to one embodiment. The graph 200 shows the return loss 201 (which can also be represented as the S-parameter or measured reflection coefficient or |S11|) of the dual-band antenna 100 of FIG. 1A. The graph 200 illustrates that the dual-band antenna 100 can be caused to radiate electromagnetic energy between approximately 2.4 GHz and 2.5 GHz in the low band 210 and between approximately 4.3 GHz and 10.0 GHz in the high band 220. In particular, the return loss is below approximately −6 decibels (dB) between approximately 2.4 GHz and 2.5 GHz and is below approximately −8 dB between approximately 4.3 GHz and 10.0 GHz. The dual-band antenna 100 provides at least three resonant modes, including one in the low band 210 at approximately 2.45 GHz and two in the high-band 220 at approximately 4.5 GHz and 8.2 GHz. Other resonant modes may be achieved and the resonant modes may cover different frequency ranges and may be centered at different frequencies than those described and illustrated herein.

Figure 3:
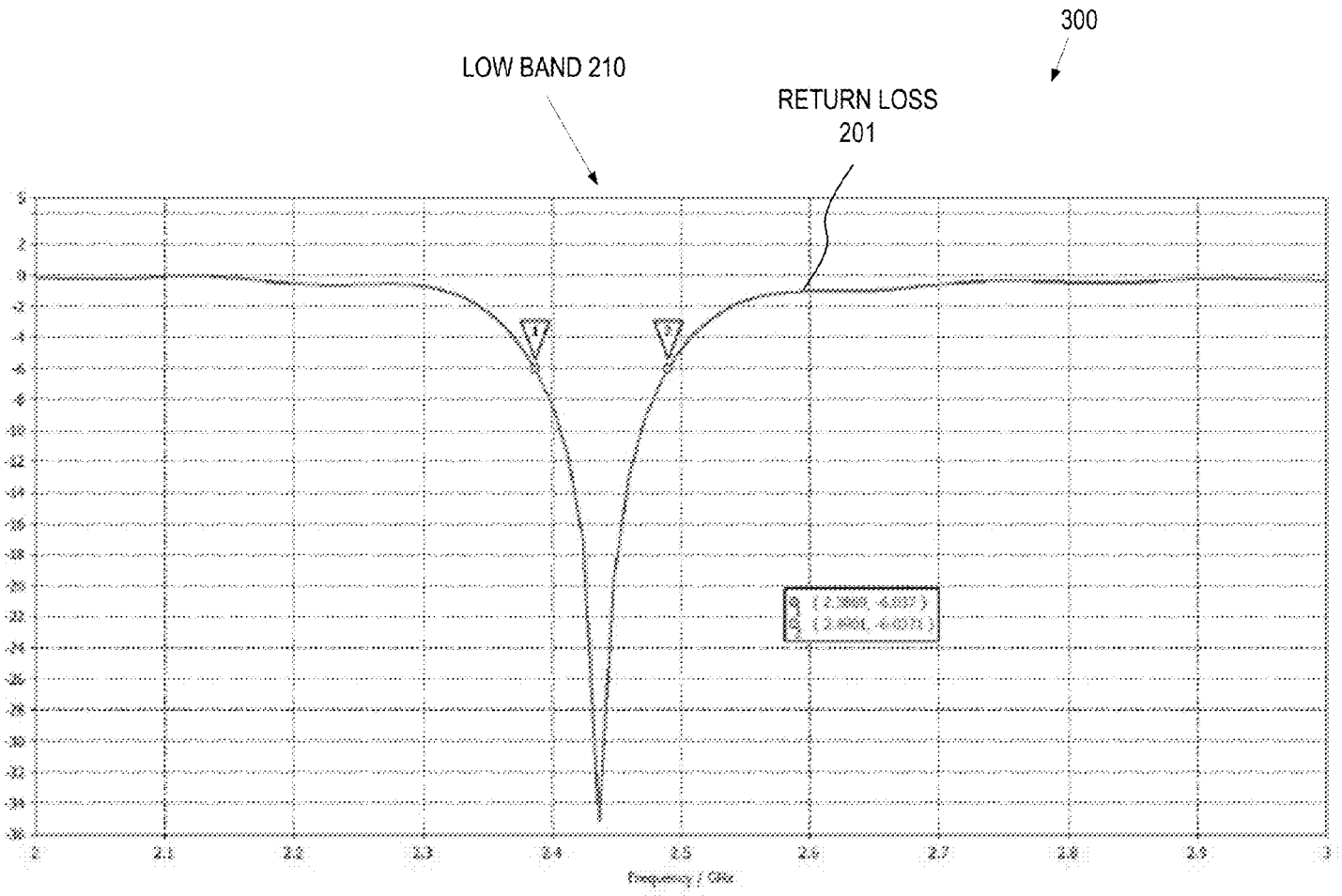
FIG. 3 is a graph of the return loss of the low band of the dual-band antenna of FIG. 1A according to one embodiment.

FIG. 3 is a graph 300 of the return loss 201 of the low band 210 of the dual-band antenna 100 of FIG. 1A according to one embodiment. The graph 300 illustrates that the dual-band antenna 100 can be caused to radiate electromagnetic energy between approximately 2.4 GHz and 2.5 GHz in the low band 210. In particular, in the low band 210, the return loss 201 is below approximately −6 decibels (dB) between approximately 2.4 GHz and 2.5 GHz.

Figure 4:
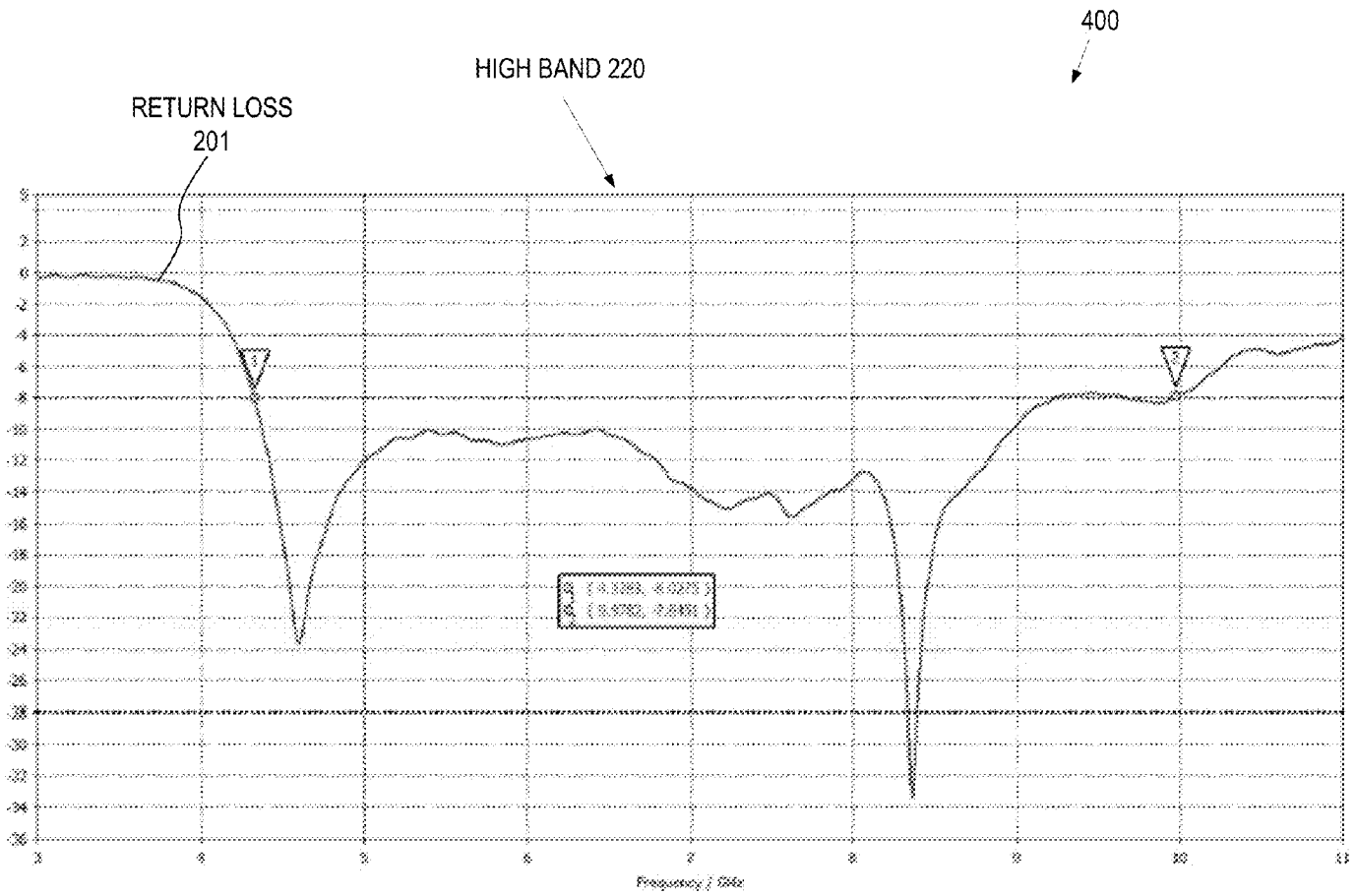
FIG. 4 is a graph of the return loss of the high band of the dual-band antenna of FIG. 1A according to one embodiment.

FIG. 4 is a graph 400 of the return loss 201 of the high band 220 of the dual-band antenna 100 of FIG. 1A according to one embodiment. The graph 400 illustrates that the dual-band antenna 100 can be caused to radiate electromagnetic energy between approximately 4.3 GHz and 10.0 GHz in the high band 220. In particular, in the high band 220, the return loss 201 is below approximately −8 decibels (dB) between approximately 4.3 GHz and 10.0 GHz.

Figure 5:
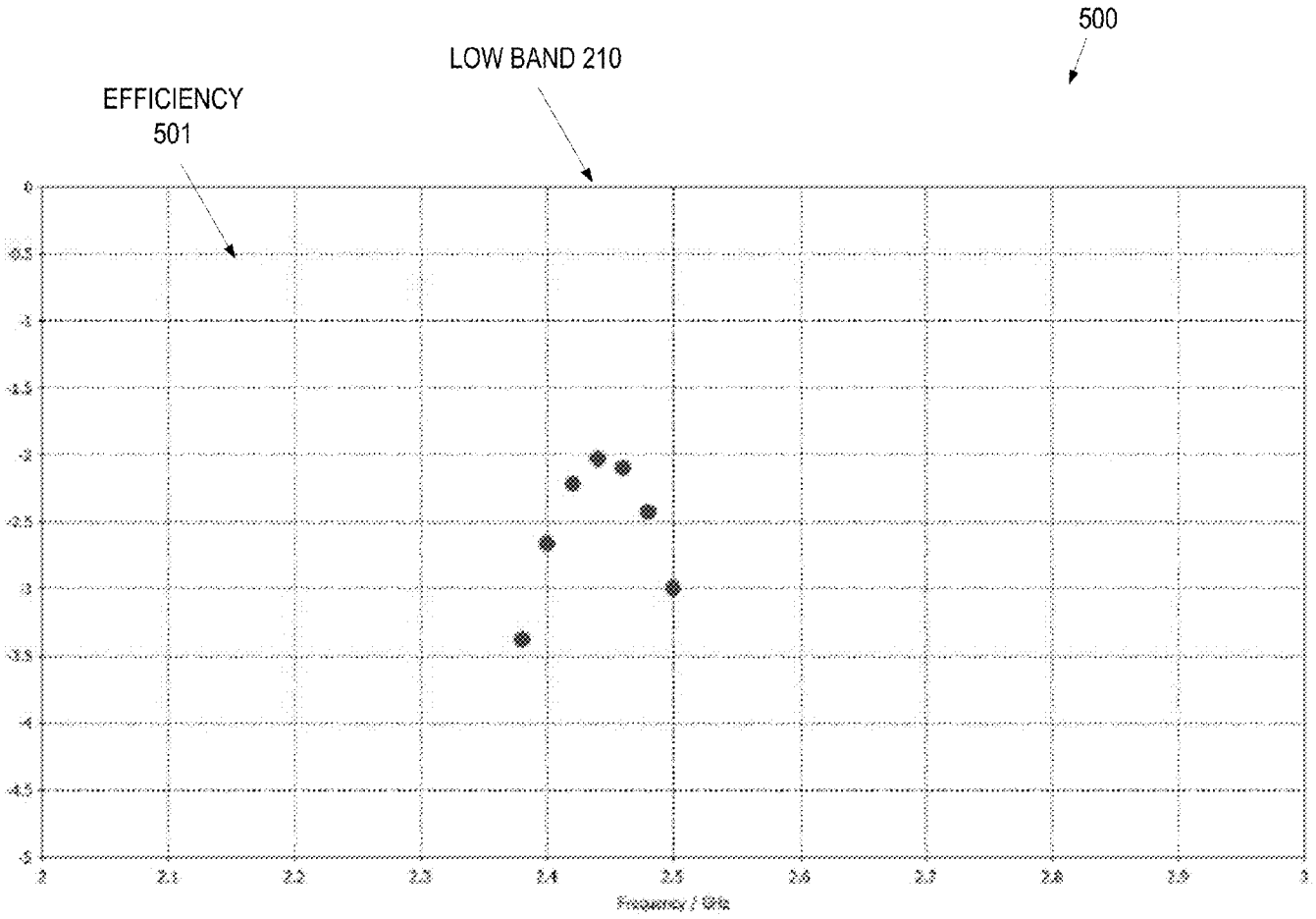
FIG. 5 is a graph of a measured efficiency in the low band of the dual-band antenna of FIG. 1A according to one embodiment.

FIG. 5 is a graph 500 of a measured efficiency in the low band 210 of the dual-band antenna 100 of FIG. 1A according to one embodiment. The graph 500 illustrates the total efficiency 501 over a frequency range in the low band 210. The graph 500 illustrates that the dual-band antenna 100 is a viable antenna for the frequency range between approximately 2.4 GHz and 2.5 GHz in the low band 210.

Figure 6:
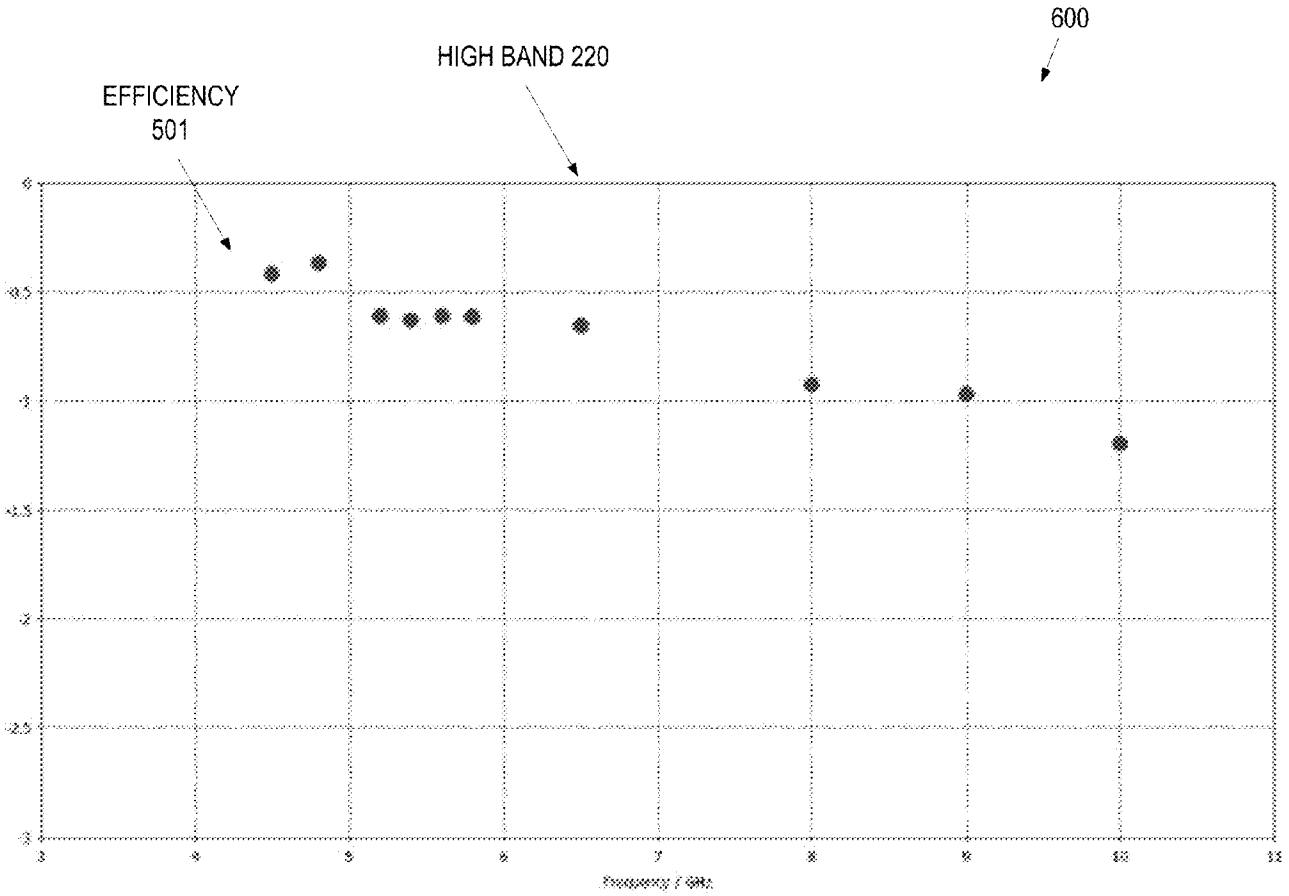
FIG. 6 is a graph of a measured efficiency in the high band of the dual-band antenna of FIG. 1A according to one embodiment.

FIG. 6 is a graph 600 of a measured efficiency in the high band 220 of the dual-band antenna 100 of FIG. 1A according to one embodiment. The graph 600 illustrates the total efficiency 501 over a frequency range in the high band 220. The graph 600 illustrates that the dual-band antenna 100 is a viable antenna for the frequency range between approximately 4.3 GHz and 10.0 GHz in the high band 220.

As would be appreciated by one of ordinary skill in the art having the benefit of this disclosure, the total efficiency of the antenna can be measured by including the loss of the structure (e.g., due to mismatch loss), dielectric loss, and radiation loss. The efficiency of the antenna can be tuned for specified target bands. The efficiency of the dual-band antenna may be modified by adjusting dimensions of the structure, the gaps between the elements of the antenna structure, or any combination thereof.

Figure 7:
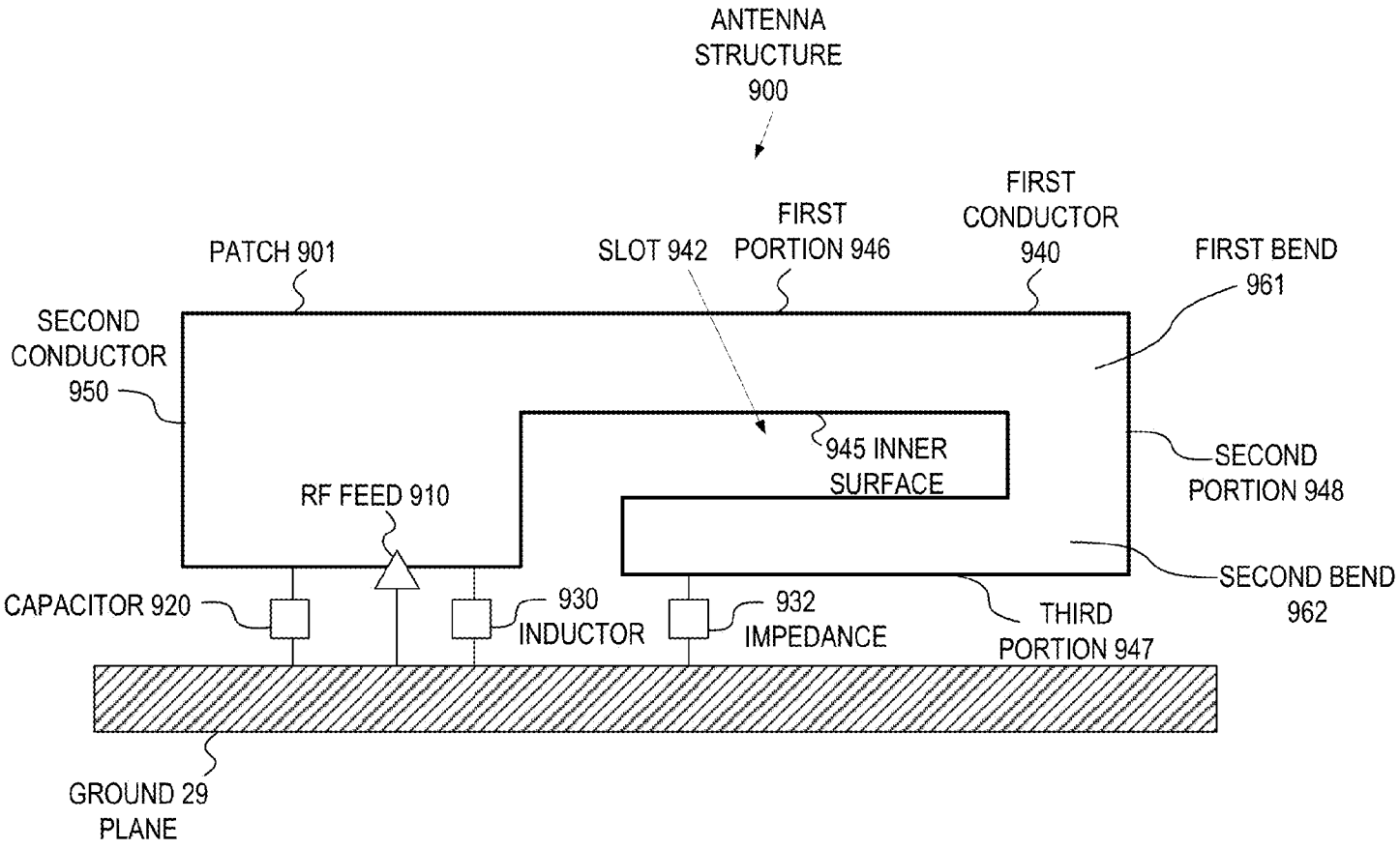
FIG. 7 is illustrates an embodiment of an antenna structure.

FIG. 7 illustrates an embodiment of an antenna structure 900. An apparatus, such as an electronic device, includes a radio frequency (RF) feed 910 and an antenna structure 900 coupled to the RF feed 910. The RF feed 910 may be a single RF feed 910. The antenna structure 900 includes a ground plane 29. The ground plane 29 may be a metal frame of an electronic device. The ground plane 29 may be a system ground or one of multiple grounds of the electronic device.

The antenna structure 900 includes a first conductor 940 coupled to the RF feed 910 and a second conductor 950 coupled to the RF feed 910. In one embodiment, the first conductor 940 extends in an opposite direction from the RF feed 910 than the second conductor 950. The antenna structure 900 may operate as a monopole antenna at a first band of frequencies using the first conductor 940 and may operate as a monopole antenna at a second band of frequencies using the second conductor 950. The first band of frequencies may include a first frequency of approximately 2.4 GHz and the second band of frequencies may include a second frequency of approximately 5.0 GHz. For example, the first band of frequencies may include approximately 2.4 GHz to 2.5 GHz and the second band of frequencies may include approximately 4.3 GHz to 10.0 GHz. The first conductor 940 and second conductor 950 may be part of a patch 901, a planar piece of metal parallel to the ground plane spaced apart from the ground plane in a direction out of the page in FIG. 7. In particular, the patch 901 may generally span a first plane and the ground plane may generally span a second plane that is spaced apart from the first plane in a direction perpendicular to the first plane and second plane.

The first conductor 940 may include an inner surface 945 defining and at least partially surrounding a slot 942. In particular, the first conductor 940 may include a first portion 946 that extends in a first direction from the RF feed to a first bend 961, a second portion 948 that extends in a second direction perpendicular to the first direction from the first bend 961 to a second bend 962, and a third portion 947 that extends in a third direction opposite the first direction from the second bend to a coupling to the ground plane 29. The first portion 946, second portion 948, and third portion 947 may define and at least partially surround a slot 942.

The second conductor 950 may include a protrusion (as shown in FIG. 1A) that extends a first distance from the ground plane 29 (or another reference line) that is greater than a second distance from the ground plane 29 that the first conductor 940 extends. In particular, in one embodiment, the first conductor 940 extends a first distance from the ground plane 29, the second conductor 950 extends a second distance from the ground plane 29, and the second distance is greater than the first distance.

The antenna structure 900 may further include an inductor 930 (or a first impedance matching component) with a first end coupled to the RF feed 910 and a second end coupled to the ground plane 29. The inductor 930 may be a discrete element or may be a portion of the patch 901. For example, the inductor 930 may be a shorting pin having a first end coupled to the first conductor 940 and a second end coupled to the ground plane 29.

The antenna structure 900 may further include a capacitor 920 (or a second impedance matching component) with a first end coupled to the RF feed 910 and a second end coupled to the ground plane 29. The capacitor 920 may be a discrete element or may be a portion of the patch 901. For example, the capacitor 920 may comprise a first surface of the second conductor 950 and a second surface of an extension of the patch 901, wherein the extension is coupled to the ground plane 29.

The third portion 947 may be coupled to the ground plane 29 via an impedance 932 (or a third impedance matching component) which may include at least one of a resistor, capacitor, or inductor. The impedance 932 may be a discrete element or may be a portion of the patch 901. For example, the impedance 932 may be a connector, such as the connector 149 of FIG. 1A.

All other components and configurations of impedance matching networks may be used to match an impedance of the antenna structure 900 to an impedance of RF circuitry to cause the antenna structure to radiate at desired frequencies or to tune the efficiency at specific frequencies.

Figure 8:
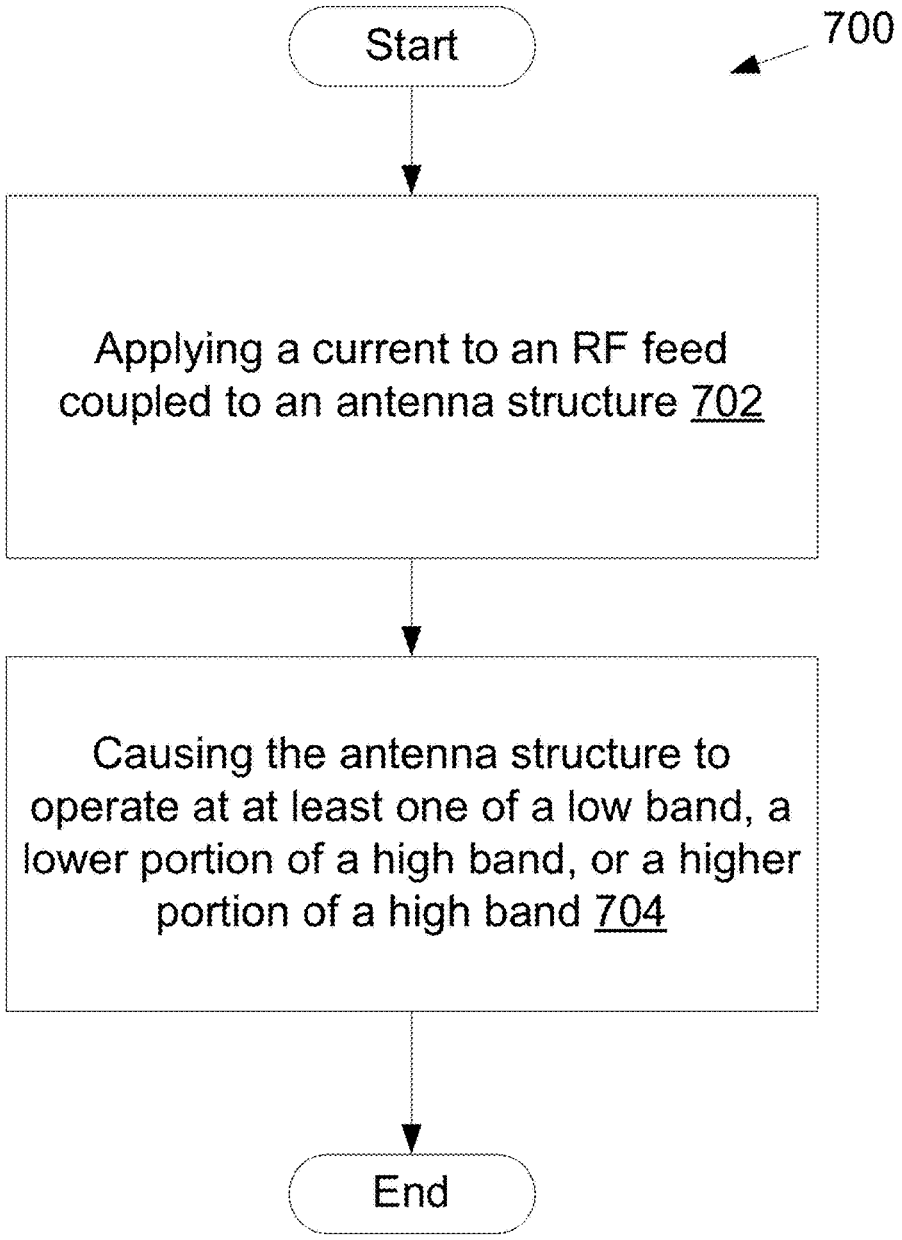
FIG. 8 is a flow diagram of an embodiment of a method of operating an electronic device having a dual-band antenna according to one embodiment.

FIG. 8 is a flow diagram of an embodiment of a method 700 of operating an electronic device having a dual-band antenna according to one embodiment. In method 700, an antenna structure (e.g., dual-band antenna 100) is coupled to an RF feed. A current is applied to the antenna structure via the RF reed to drive the antenna structure to radiate electromagnetic energy (block 702). In response to applying the current, electromagnetic energy is radiated from the antenna structure. The antenna structure is caused to operate at at least one of a low band, a lower portion of a high band, or a higher portion of a high band (block 704).

In response to the applied current(s), when applicable, the antenna structure radiates electromagnetic energy to communicate information to one or more other devices. Regardless of the antenna configuration, the electromagnetic energy forms a radiation pattern. The radiation pattern may be various shapes as would be appreciated by one of ordinary skill in the art having the benefit of this disclosure.

Causing the antenna to operate at the low band may include causing the antenna structure to radiate electromagnetic energy at a first frequency between approximately 2.4 GHz and 2.5 GHz. Causing the antenna to operate a lower portion of the high band may include causing the antenna structure to radiate electromagnetic energy at a second frequency between approximately 4.3 GHz to 7.0 GHz. Causing the antenna to operate at a higher portion of the high band may include causing the antenna structure to radiate electromagnetic energy at a third frequency between approximately 7.0 and 10.0 GHz.

Causing the antenna structure to radiate electromagnetic energy at the low band may include causing the antenna structure to operate as a monopole antenna using the first conductor. Similarly, causing the antenna structure to radiate electromagnetic energy at the lower portion of the high band may include causing the antenna structure to operate as a monopole antenna using the second conductor. Causing the antenna structure to radiate electromagnetic energy at the higher portion of the high band may include causing the antenna structure to radiate a higher harmonic using the first conductor.

Figure 9:
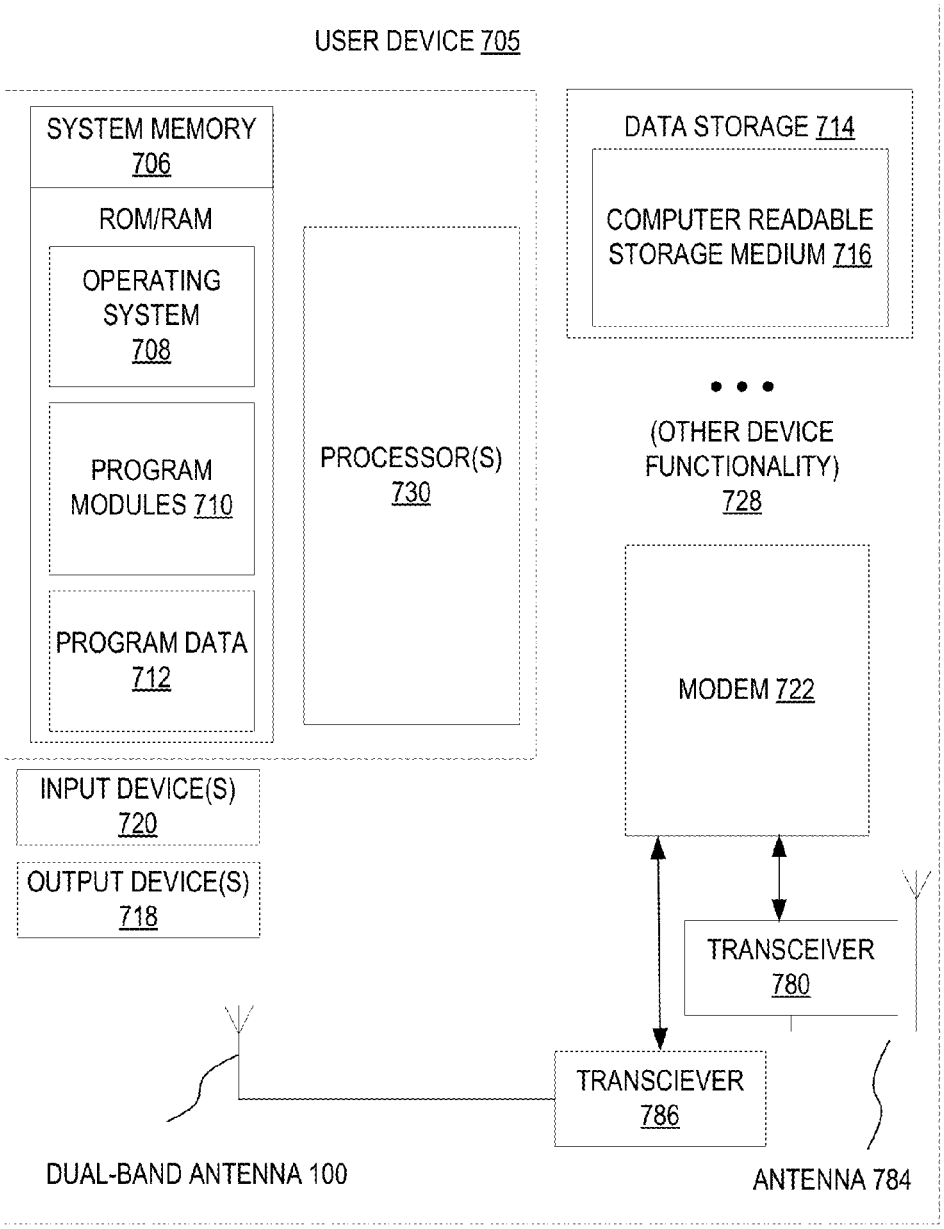
FIG. 9 is a block diagram of a user device having the dual-band antenna of FIG. 1A according to one embodiment.

FIG. 9 is a block diagram of a user device 705 having the dual-band antenna 100 of FIG. 1A according to one embodiment. The user device 705 includes one or more processors 730, such as one or more CPUs, microcontrollers, field programmable gate arrays, or other types of processing devices. The user device 705 also includes system memory 706, which may correspond to any combination of volatile and/or non-volatile storage mechanisms. The system memory 706 stores information which provides an operating system component 708, various program modules 710, program data 712, and/or other components. The user device 705 performs functions by using the processor(s) 730 to execute instructions provided by the system memory 706.

The user device 705 also includes a data storage device 714 that may be composed of one or more types of removable storage and/or one or more types of non-removable storage. The data storage device 714 includes a computer-readable storage medium 716 on which is stored one or more sets of instructions embodying any one or more of the functions of the user device 705, as described herein. As shown, instructions may reside, completely or at least partially, within the computer readable storage medium 716, system memory 706 and/or within the processor(s) 730 during execution thereof by the user device 705, the system memory 706 and the processor(s) 730 also constituting computer-readable media. The user device 705 may also include one or more input devices 720 (keyboard, mouse device, specialized selection keys, etc.) and one or more output devices 718 (displays, printers, audio output mechanisms, etc.).

The user device 705 further includes a wireless modem 722 to allow the user device 705 to communicate via a wireless network (e.g., such as provided by a wireless communication system) with other computing devices, such as remote computers, an item providing system, and so forth. The wireless modem 722 allows the user device 705 to handle both voice and non-voice communications (such as communications for text messages, multimedia messages, media downloads, web browsing, etc.) with a wireless communication system. The wireless modem 722 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1×RTT), evaluation data optimized (EVDO), high-speed downlink packet access (HSDPA), Wi-Fi®, etc. In other embodiments, the wireless modem 722 may communicate according to different communication types (e.g., WCDMA, GSM, LTE, CDMA, WiMax, etc) in different cellular networks. The cellular network architecture may include multiple cells, where each cell includes a base station configured to communicate with user devices within the cell. These cells may communicate with the user devices 705 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 705 to communicate with other devices, such as other user devices, server computing systems, telephone devices, or the like. In addition to wirelessly connecting to a wireless communication system, the user device 705 may also wirelessly connect with other user devices. For example, user device 705 may form a wireless ad hoc (peer-to-peer) network with another user device.

The wireless modem 722 may generate signals and send these signals to transceiver 780 or transceiver 786 for amplification, after which they are wirelessly transmitted via the dual-band antenna 100 or antenna 784, respectively. Although FIG. 9 illustrates transceivers 780 and 786, in other embodiments, power amplifiers or other RF circuitry may be used. The antenna 784, which is an optional antenna that is separate from the dual-band antenna 100, may be any directional, omnidirectional, or non-directional antenna in a different frequency band than the frequency bands of the dual-band antenna 100. The antenna 784 may also transmit information using different wireless communication protocols than the dual-band antenna 100. In addition to sending data, the dual-band antenna 100 and the antenna 784 also receive data, which is sent to wireless modem 722 and transferred to processor(s) 730. It should be noted that, in other embodiments, the user device 705 may include more or less components as illustrated in the block diagram of FIG. 9.

In one embodiment, the user device 705 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a Wi-Fi® hotspot and a connection to a wireless carrier system. In one embodiment, the first wireless connection is associated with a first resonant mode of the dual-band antenna 100 that operates at a first frequency band and the second wireless connection is associated with a second resonant mode of the dual-band antenna 100 that operates at a second frequency band. In another embodiment, the first wireless connection is associated with the dual-band antenna 100 and the second wireless connection is associated with the antenna 784. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 722 is shown to control transmission to both antennas 100 and 784, the user device 705 may alternatively include multiple wireless modems, each of which is configured to transmit/receive data via a different antenna and/or wireless transmission protocol. In addition, the user device 705, while illustrated with two antennas 100 and 784, may include more or fewer antennas in various embodiments.

The user device 705 delivers and/or receives items, upgrades, and/or other information via the network. For example, the user device 705 may download or receive items from an item providing system. The item providing system receives various requests, instructions, and other data from the user device 705 via the network. The item providing system may include one or more machines (e.g., one or more server computer systems, routers, gateways, etc.) that have processing and storage capabilities to provide the above functionality. Communication between the item providing system and the user device 705 may be enabled via any communication infrastructure. One example of such an infrastructure includes a combination of a wide area network (WAN) and wireless infrastructure, which allows a user to use the user device 705 to purchase items and consume items without being tethered to the item providing system via hardwired links. The wireless infrastructure may be provided by one or multiple wireless communications systems, such as one or more wireless communications systems. One of the wireless communication systems may be a wireless fidelity (Wi-Fi®) hotspot connected with the network. Another of the wireless communication systems may be a wireless carrier system that can be implemented using various data processing equipment, communication towers, etc. Alternatively, or in addition, the wireless carrier system may rely on satellite technology to exchange information with the user device 705.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 705 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 705 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments of the present invention may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments of the present invention also relate to an apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general purpose systems may be used with programs in accordance with the teachings herein, or it may prove convenient to construct a more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present invention should, therefore, be determined with reference to the appended claims, along with the full scope of equivalents to which such claims are entitled.

What is claimed is:

1. An electronic device comprising:
a single radio frequency (RF) feed; and
a dual-band antenna comprising:
a ground plane; and
a patch coupled to the RF feed, wherein the patch comprises:
a grounding strip coupling the patch to the ground plane;
a first arm coupled to the RF feed and extending in a first direction from the RF feed, the first arm comprising a first portion that extends in the first direction from the RF feed to a first bend, a second portion that extends in a second direction perpendicular to the first direction from the first bend to a second bend, and a third portion that extends in a third direction opposite the first direction from the second bend to a connector coupled to the grounding strip, wherein the first portion, second portion, and third portion define an inner surface that surrounds a slot;
an inductor with a first end coupled to the RF feed and a second end coupled to the grounding strip; and
a second arm coupled to the RF feed and extending from the RF feed in the third direction; and
an extension coupled to the grounding strip and extending in the third direction, wherein a first surface of the second arm and a second surface of the extension form a capacitor,
wherein the dual-band antenna operates as a folded monopole antenna at a first band of frequencies using the first arm as a conductor and operates as a planar inverted-F antenna at a second band of frequencies using the second arm as a conductor.

2. The electronic device of claim 1, wherein the first band of frequencies comprises a first frequency range between approximately 2.4 gigahertz (GHz) and 2.5 GHz and the second band of frequencies comprises a second frequency range between approximately 4.3 GHz and 10.0 GHz.

3. The electronic device of claim 1, wherein the connector comprises at least one of a resistor, inductor, or capacitor.

4. An apparatus comprising:
a radio frequency (RF) feed; and
an antenna structure coupled to the RF feed, wherein the antenna structure comprises:
a ground plane;
a first conductor coupled to the RF feed, the first conductor having a first portion extending in a first direction from the RF feed to define a first section of an inner surface that at least partially surrounds a slot, a second portion extending from the first portion in a second direction perpendicular to the first direction to define a second section of the inner surface, and a third portion extending from the second portion in a third direction opposite the first direction to a connector to the ground plane to define a third section of the inner surface;

a second conductor coupled to the RF feed;

a first impedance matching component with a first end coupled to the RF feed and a second end coupled to the ground plane; and a second impedance matching component with a first end coupled to the RF feed and a second end coupled to the ground plane.

5. The apparatus of claim 4, wherein the first impedance matching component comprises an inductor and the second impedance matching component comprises a capacitor.

6. The apparatus of claim 5, wherein the inductor comprises a shorting pin having a first end coupled to the first conductor and a second end coupled to the ground plane.

7. The apparatus of claim 5, wherein the capacitor comprises a first surface of the second conductor and a second surface of an extension coupled to the ground plane.

8. The apparatus of claim 4, wherein the antenna structure operates as a folded monopole antenna for a first band of frequencies using the first conductor and operates as a planar invented-F antenna for a second band of frequencies using the second conductor.

9. The apparatus of claim 4, wherein the antenna structure is to operate at a first band of frequencies comprises approximately 2.4 GHz to 2.5 GHz and at a second band of frequencies comprising approximately 4.3 GHz to 10.0 GHz.

10. The apparatus of claim 4, wherein the antenna structure comprises a patch comprising the first conductor and the second conductor, wherein the patch is a planar piece of metal generally spanning a first plane, the ground plane generally spans a second plane, and the first plane and second plane are spaced apart in a direction perpendicular to the first plane and the second plane.

11. The apparatus of claim 10, wherein the patch further comprises at least a portion of the first impedance matching component and at least a portion of the second impedance matching component.

12. The apparatus of claim 4, wherein the first conductor comprises a first portion extending in a first direction from the RF feed to a first bend, a second portion extending in a second direction perpendicular to the first direction from the first bend to a second bend, and a third portion extending in a third direction opposite the first direction from the second bend to a connector coupled to the ground plane, wherein the first portion, second portion, and third portion define and at least partially surround the slot.

13. The apparatus of claim 12, wherein the connector comprises a third impedance matching component, the third impedance matching component comprising at least one of a resistor, capacitor, or inductor.

14. The apparatus of claim 4, wherein the first conductor extends a first distance from the ground plane, the second conductor extends a second distance from the ground plane, and the second distance is greater than the first distance.

15. The apparatus of claim 4, wherein the first conductor extends from the RF feed in a first direction and the second conductor extends from the RF feed in a second direction opposite the first direction.

16. A device comprising:

a planar piece of metal comprising:

a first arm extending from a reference point in a first direction, wherein the first arm comprises a first portion extending in the first direction from the reference point to a first bend, a second portion extending in a second direction perpendicular to the first direction from the first bend to a second bend, and a third portion extending in a third direction opposite the first direction from the second bend;

a second arm extending from the reference point in the third direction;

a strip extending in the first direction and spaced apart from the first arm and the second arm in the second direction;

a shorting pin extending in the second direction from the first arm to the strip; and an extension extending in the third direction and spaced apart from the second arm in the second direction.

17. The device of claim 16, wherein the shorting pin introduces an inductance between the first arm and the strip of approximately 4 to 6 nanohenries.

18. The device of claim 16, wherein the extension introduces a capacitance between the second arm and the strip of approximately 0.5 to 2.0 picofarads.

19. The device of claim 16, wherein the planar piece of metal further comprises:

a first connector extending in the second direction from the third portion to the strip; and a second connector extending in the second direction from the extension to the strip.

20. The device of claim 16, further comprising a radio frequency (RF) feed coupled to the reference point.

* * * * *